US007608772B2

(12) United States Patent
Kato

(10) Patent No.: US 7,608,772 B2
(45) Date of Patent: Oct. 27, 2009

(54) BLACK KEY FOR KEYBOARD INSTRUMENT AND METHOD OF MANUFACTURING A BLACK KEY COVER

(75) Inventor: Haruichi Kato, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 12/108,379

(22) Filed: Apr. 23, 2008

(65) Prior Publication Data

US 2008/0257132 A1 Oct. 23, 2008

(30) Foreign Application Priority Data

Apr. 23, 2007 (JP) ..... 2007-113067

(51) Int. Cl.
*G10C 3/12* (2006.01)

(52) U.S. Cl. ..... 84/433; 84/423 R; 84/430; 84/439; 84/440

(58) Field of Classification Search ..... 84/423 R, 84/430, 433, 439, 440
See application file for complete search history.

(56) References Cited

U.S. PATENT DOCUMENTS 4,512,234 A * 4/1985 Kumano ..... 84/433
5,585,582 A * 12/1996 Stanwood ..... 84/432
5,796,024 A * 8/1998 Stanwood ..... 84/433
6,531,651 B2 * 3/2003 Kanemitsu et al. ..... 84/433
6,693,235 B2 * 2/2004 Ookubo ..... 84/433
7,067,730 B2 * 6/2006 Inoue ..... 84/423 R
7,129,404 B2 * 10/2006 Inoue ..... 84/433
7,411,122 B2 * 8/2008 Yamaguchi ..... 84/423 R
2007/0295193 A1 * 12/2007 Toyama ..... 84/423 R
2008/0257132 A1 * 10/2008 Kato ..... 84/433
2009/0038466 A1 * 2/2009 Elliger ..... 84/433

FOREIGN PATENT DOCUMENTS

JP 2001-147686 5/2001

* cited by examiner

*Primary Examiner*—Jeffrey Donels
*Assistant Examiner*—Robert W Horn
(74) *Attorney, Agent, or Firm*—Crowell & Moring LLP

(57) ABSTRACT

A black key for a keyboard instrument, in which a black key cover incorporating a weight can be manufactured at low costs, and the black key cover can be firmly mounted on a key body, in a state stably holding the weight in a black key cover body. A swingable key body extends in a front-rear direction. A black key cover body has a hollow shape opening downward, and is mounted on a front portion of the upper surface of the key body in a manner covering the front portion. A weight is received within the black key cover body. The black key cover body has at least one of lower walls protruding inward from lower portions of left and right side walls, for holding the weight from below. The lower surfaces of the lower walls are bonded to the key body.

12 Claims, 5 Drawing Sheets

BLACK KEY FOR KEYBOARD INSTRUMENT AND METHOD OF MANUFACTURING A BLACK KEY COVER

BACKGROUND OF THE INVENTION

1. Field of the Invention

The present invention relates to a black key for a keyboard instrument, such as a piano, and more particularly to a black key incorporating a weight in a black key cover so as to obtain desired touch weight, and a method of manufacturing the black key cover.

2. Description of the Related Art

Conventionally, as a black key of this kind, one disclosed in Japanese Laid-Open Patent Publication (Kokai) No. 2001-147686 is known. This black key includes a slim wooden key body having a rectangular shape in cross section, and a black key cover mounted on a front portion of an upper surface of the key body. The black key cover is comprised of a black key cover body and a weight received therein. The key body is swingably supported at a central portion thereof by a balance rail pin. The black key cover body, which is made of a molded article of a synthetic resin, such as phenol, is formed to have a hollow shape opening downward, and has a hollow portion having a trapezoid shape in cross section. Further, the weight has a shape complementary to the hollow portion of the black key cover body such that it is fitted into the hollow portion.

In assembling the black key configured as above, first, the weight is fitted into the hollow portion of the black key cover body, and is bonded to the same. After that, the black key cover of the black key is bonded to the front portion of the upper surface of the key body, which completes the assembly of the black key. In this case, to ensure excellent bonding of the black key cover to the key body, it is preferable that the weight is mounted in the black key cover body in a state slightly indented from the lower surface of the black key cover body, whereafter the lower surface of the black key cover body is cut such that the respective lower surfaces of the black key cover body and the weight make a flat and smooth surface.

In this black key, it is necessary to carry out the steps of making the black key cover body and the weight separately from each other, fitting the weight into the hollow portion of the black key cover body, and bonding the weight to the black key cover body, which increases the manufacturing costs of the black key cover. Further, as described above, if the weight is mounted in the black key cover body in the state slightly indented from the lower surface of the black key cover body, the black key cover is bonded to the key body only via the lower surface of the black key cover body, resulting in a reduced bonding area. As a result, if the black key cover is not properly bonded to the key body, there is a fear that the black key cover comes off the key body. Further, in the above-described case, if the weight becomes separate from the black key cover body e.g. due to faulty bonding thereof, the weight rattles within the black key cover body when the black key is depressed, thereby causing offensive noise.

SUMMARY OF THE INVENTION

It is an object of the present invention to provide a black key for a keyboard instrument, in which a black key cover incorporating a weight can be manufactured at low costs, and the black key cover can be firmly mounted on a key body, in a state stably holding the weight in a black key cover body, and a method of manufacturing the black key cover.

To attain the above object, in a first aspect of the present invention, there is provided a black key for a keyboard instrument, comprising a key body that extends in a front-rear direction and is swingable, a black key cover body that is formed into a hollow shape opening downward, and is mounted on a front portion of an upper surface of the key body in a manner covering the front portion, and a weight that is received in the black key cover body and adds weight to the key body, wherein the black key cover body has a lower wall protruding inward from a lower portion of at least one of left and right side walls, for holding the weight from below, the lower wall having a lower surface bonded to the key body.

With the construction of the black key according to the first aspect of the present invention, the black key cover body having the hollow shape opening downward receives therein the weight for applying weight to the key body, and is mounted on the front portion of the upper surface of the key body in a manner covering the front portion. Further, the black key cover body has the lower wall protruding inward from the lower portion of at least one of the left and right side walls, and the lower wall holds the weight from below. This causes the weight to be stably held in the black key cover body, and prevents the same from rattling within the black key cover body when the black key is depressed. Further, since the lower wall of the black key cover body protrudes inward, the area of the lower surface of the lower wall becomes relatively large, which increases a bonding area where the black key cover body is bonded to the key body. What is more, since the weight in the black key cover body is positioned above the lower wall, it is possible to ensure cutting of the lower surface of the lower wall into a smooth surface. Therefore, the black key cover body can be favorably bonded to the key body, thereby making it possible to firmly mount the black key cover body on the key body. Furthermore, the black key cover comprising the black key cover body and the weight received therein is configured such that the black key cover body and the weight can be integrally formed with each other by insert molding. This makes it possible to manufacture the black key at lower costs than that of the conventional black key which necessitates the steps of manufacturing the black key cover body and the weight separately from each other, fitting the weight into the black key cover body, and bonding the former to the latter.

Preferably, the lower wall has left and right wall portions opposed to each other, and surfaces of the left and right wall portions, opposed to each other, are formed to be tapered such that the surfaces become closer to each other as the surfaces extend toward the weight.

With the arrangement of the preferred embodiment, the surfaces of the left and right wall portions of the lower wall, opposed to each other, are formed to be tapered such that the surfaces become closer to each other as the surfaces extend toward the weight. In other words, the surfaces opposed to each other are formed to be tapered such that they become more distant from each other as they extend outward. Therefore, when the black key cover is molded with a mold by the insert molding, described hereinafter, it is possible to remove the black key cover from the mold easily.

To attain the above object, in a second aspect of the present invention, there is provided a method of manufacturing a black key cover for a keyboard instrument, comprising a weight-preparing step of preparing a rod-shaped weight having a predetermined width, a mold-preparing step of preparing a lower mold that has a base extending horizontal, and a pedestal provided on and along the base and having a width smaller than a width of the weight, the base and the pedestal being integrally formed with each other, and an upper mold that has a cavity opening downward and complementary to a black key cover to be molded, a weight-setting step of setting the weight on and along the pedestal, and a black key cover-molding step of overlaying the upper mold upon the lower mold such that the pedestal and the weight are received within the cavity, and performing insert molding of the black key cover together with the weight, using a synthetic resin supplied to the cavity.

In the method of manufacturing a black key cover for a keyboard instrument, according to the second aspect of the present invention, first, a weight is prepared, and lower and upper molds are prepared. As the weight, a rod-shaped weight having a predetermined width is prepared. Further, as the lower mold, there is prepared a lower mold comprising a horizontal base and a pedestal provided on the base and having a width smaller than the width of the weight, the base and the pedestal being integrally formed with each other. On the other hand, as the upper mold, there is prepared an upper mold that has a cavity opening downward and complementary to the black key cover to be molded. Next, the weight is set on and along the pedestal. Then, the upper mold and the lower mold are overlaid upon each other such that the pedestal and the weight are received in the cavity, and the insert molding of the black key cover and the weight is carried out using a synthetic resin supplied to the cavity. By the insert molding described above, the synthetic resin within the cavity is filled around the pedestal of the lower mold and weight, and is set.

As described above, since the width of the pedestal of the lower mold is smaller than that of the weight, the molten synthetic resin in the cavity flows in under the weight, and the synthetic resin having flowed in under the weight forms the lower wall for holding the weight from below. As a result, there is formed a black key cover having the same black key cover body and weight as those of the first aspect of the present invention, that is, a black key cover in which the black key cover body has the weight received therein, and holds the same from below with a lower wall thereof. Further, the black key cover body is fused to the weight by the above-described insert molding, which makes it possible to easily manufacture the black key cover in which the black key cover body and the weight are integrally formed with each other, and the weight is stably held therein.

To attain the above object, in a third aspect of the present invention, there is provided a method of manufacturing a black key cover for a keyboard instrument, comprising a weight-preparing step of preparing a rod-shaped weight, a mold-preparing step of preparing a lower mold that has a base extending horizontal, and a pedestal provided on the base, for defining a space between the weight and the base when the weight is set along the base, the base and the pedestal being integrally formed with each other, and an upper mold that has a cavity opening downward and complementary to a black key cover to be molded, a weight-setting step of setting the weight on the pedestal such that the weight extends along the base, and a black key cover-molding step of overlaying the upper mold upon the lower mold such that the pedestal and the weight are received within the cavity, and performing insert molding of the black key cover together with the weight, using a synthetic resin supplied to the cavity.

In the method of manufacturing a black key cover for a keyboard instrument, according to the third aspect of the present invention, similarly to the second aspect of the present invention, first, a rod-shaped weight is prepared, and lower and upper molds are prepared. As the lower mold, there is prepared a lower mold that has a base extending horizontal, and a pedestal provided on the base, for defining a space between the weight and the base when the weight is set along the base, the base and the pedestal being integrally formed with each other. Then, the weight is set on the pedestal along the pedestal. After that, by the same black key cover-molding step as that of the second aspect of the present invention, the black key cover and the weight are molded by insert molding, whereby the synthetic resin in the cavity is filled around the pedestal and weight of the lower mold, and is set.

As described above, since the space is defined between the weight set on the pedestal and the base, the molten synthetic resin in the cavity flows in under the weight, and fills the space. Then, the filled synthetic resin forms the lower wall for holding the weight from below. Further, by minimizing the size of the pedestal having the weight set thereon, the space is increased to accordingly increase the size of the lower wall of the black key cover. Therefore, when the black key cover is mounted on the key body, by bonding the lower wall to the key body, the bonding area where the black key cover is bonded to the key body becomes large, whereby the bonding strength of the black key cover is increased. This makes it possible to firmly mount the black key cover on the key body.

In the second and third aspects of the present invention, the black key cover-molding step comprises a raw material supply step of supplying the synthetic resin in a powder form as a raw material of the black key cover body, in a manner covering the pedestal on the base and the weight set on the pedestal, and a pressurizing and heating step of overlaying the upper mold upon the lower mold such that the pedestal and the weight are received within the cavity, and pressurizing and heating the synthetic resin within the cavity, thereby molding the black key cover.

With the construction of the preferred embodiment, in the black key cover-molding step, the synthetic resin is supplied in a powder form as a raw material of the black key cover body, in a manner covering the pedestal on the base and the weight set on the pedestal. Then, the upper mold is overlaid upon the lower mold such that the pedestal and the weight are received within the cavity, and the synthetic resin within the cavity is pressurized and heated. By this pressurizing and heating step, the synthetic resin within the cavity is filled around the pedestal of the lower mold and the weight in a molten state under a relatively high pressure, and is set, whereby the black key cover incorporating the weight is molded. As described above, after supplying the synthetic resin, the upper mold is overlaid on the lower mold, whereby the black key cover is molded. Therefore, the black key cover can be molded more easily than when it is molded by a method, such as injection molding, in which the upper mold and the lower mold are overlaid in advance, and the synthetic resin is supplied to the cavity hermetically sealed by the upper and lower molds.

In the second and third aspects of the present invention, preferably, the pedestal includes a positioning portion that is engaged with the set weight, and positions the weight at a predetermined location.

With the construction of the preferred embodiment, when the weight is set on the pedestal, the weight is engaged with the positioning portion, whereby it is positioned at a predetermined location. This makes it possible to easily obtain a black key cover that holds the weight in an appropriate position within the same.

In the second and third aspects of the present invention, more preferably, the weight has a lower surface provided with an engaging portion formed by one of a protrusion and a recess, and the positioning portion is formed by the other of the protrusion and the recess, for engagement with the engaging portion.

With the construction of the preferred embodiment, in the weight-setting step of setting the weight on the pedestal, the weight can be easily set on the pedestal simply by causing the engaging portion of the weight, formed by one of the protrusion and the recess, to be engaged with the positioning portion of the pedestal, formed by the other of the protrusion and the recess.

In the second and third aspects of the present invention, preferably, the pedestal is formed by a magnet, and the weight is made of a magnetic material attracted by the pedestal.

With the construction of the preferred embodiment, the pedestal is formed by a magnet and the weight is made of a magnetic material attracted by the pedestal. Therefore, the weight set on the pedestal is attracted by the pedestal. This makes it possible to prevent the weight from being lifted by pressure of the synthetic resin having flowed in under the weight, during molding of the black key cover. This makes it possible to make smaller the width of the pedestal and the pedestal itself, whereby the lower wall of the black key cover body, which is formed by the synthetic resin having flowed in under the weight, is made larger. As a result, the area of the lower surface of the lower wall becomes larger, whereby it is possible to increase the bonding area where the black key cover body is bonded to the key body. This makes it possible to more firmly mount the black key cover on the key body.

The above and other objects, features, and advantages of the present invention will become more apparent from the following detailed description taken in conjunction with the accompanying drawings.

DETAILED DESCRIPTION OF PREFERRED EMBODIMENTS

Figure 1:
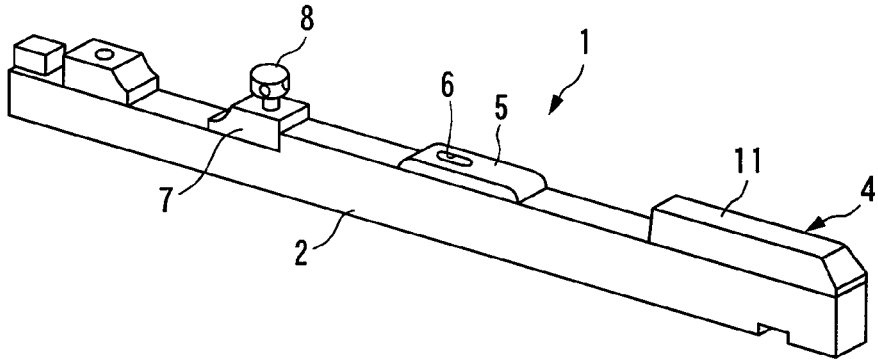
FIG. 1 is a perspective view of a black key for a grand piano, according to an embodiment of the present invention.

The invention will now be described in detail with reference to the drawings showing a preferred embodiment thereof. FIG. 1 shows a black key for a grand piano to which is applied the present invention. As shown in FIG. 1, the black key 1 is comprised of a key body 2, a black key cover 4 incorporating a weight 3 (see FIGS. 2A to 2D) that applies weight to the key body 2, and so forth.

The key body 2 is made of a wooden material, such as spruce, which is relatively light in weight, tough, and elastic. The key body 2 has a rectangular shape in cross section, and extends in a front-rear direction. A middle plate 5 is bonded to a central portion of an upper surface of the key body 2, and a balance rail pin hole 6 is formed such that it vertically extends through the key body 2 and the middle plate 5. The balance rail pin hole 6 is engaged with an erected balance rail pin (not shown), whereby the black key 1 is swingably supported. Further, a capstan screw 8 is mounted on the key body 2 via a capstan plate 7 at a location backward of the balance rail pin hole 6 on the upper surface of the key body 2. An action (not shown) is placed on the capstan screw 8. With this arrangement, when the front portion of the black key 1 is depressed, the black key 1 is swung about the balance rail pin, and in accordance with the swinging motion of the black key 1, the action is pushed up by the capstan screw 8, for operation.

Figure 2A:
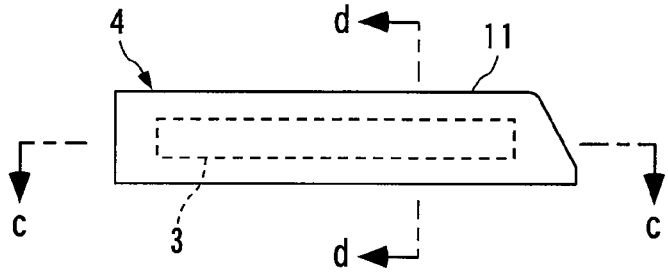
FIG. 2A is a side view of a black key cover incorporating a weight.
Figure 2B:
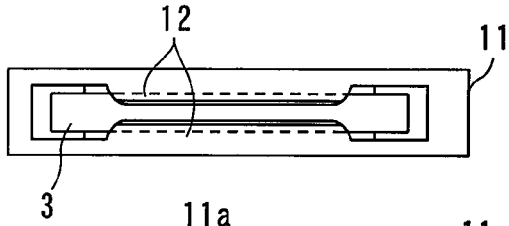
FIG. 2B is a bottom view of the black key cover incorporating the weight.
Figure 2C:
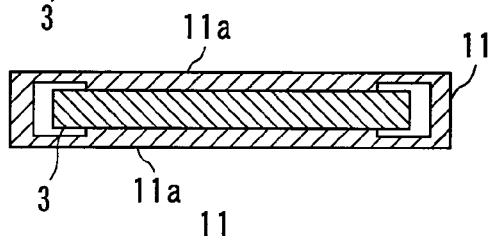
FIG. 2C is a cross-sectional view taken on line c-c of FIG. 2A.
Figure 2D:
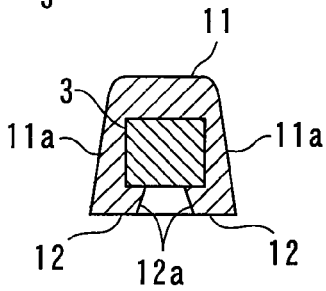
FIG. 2D is a cross-sectional view taken on line d-d of FIG. 2A.

Referring to FIGS. 2A to 2D, the black key cover 4 is comprised of a black key cover body 11, and the weight 3 received within the black key cover body 11. The black key cover body 11, made of a synthetic resin, such as a phenol resin, extends in the front-rear direction, and is formed into a hollow shape opening downward. Further, the black key cover body 11 has a pair of left and right lower walls 12 and 12 (wall portions) which protrude inward from lower portions of left and right side walls 11*a* and 11*a* in a manner opposed to each other. As shown in FIG. 2D, surfaces 12*a* and 12*a* of the lower walls 12 and 12, opposed to each other, are formed to be tapered such that they become closer to each other as they extend toward the weight 3 disposed thereabove.

On the other hand, the weight 3 is made e.g. of a metal (such as iron, tungsten, or stainless steel) having a relatively large specific gravity, and has a rod-like shape rectangular in cross section. More specifically, the weight 3 has a length shorter than the longitudinal dimension of the black key cover body 11, and a width longer than a dimension of spacing between the left and right lower walls 12 and 12 of the black key cover body 11. Therefore, as shown in FIGS. 2B and 2D, the weight 3 is held by the left and right lower walls 12 and 12 from below.

The black key cover 4 configured as above is formed by integrally molding the black key cover body 11 and the weight 3 by insert molding, as described hereinafter. The black key cover 4 has a lower surface thereof bonded to the front portion of the upper surface of the key body 2 in a manner covering the same.

As described above, according to the black key 1, the black key cover body 11 has the lower walls 12 and 12 which protrude inward from the lower portions of the left and right side walls 11*a* and 11*a*, and the weight 3 is held by the lower walls 12 and 12 from below. With this arrangement, the weight 3 is stably held, and prevented from being unstable or rattling within the black key cover body 11 when the black key 1 is depressed. Further, since the lower walls 12 and 12 of the black key cover body 11 protrude inward, the areas of the lower surfaces thereof become relatively large to increase a bonding area where the black key cover body 11 is bonded to the key body 2. What is more, since the weight 3 in the black key cover body 11 is positioned above the lower walls 12 and 12, it is possible to ensure cutting of the lower surfaces of the lower walls 12 and 12 into smooth surfaces. Therefore, the black key cover body 11 can be favorably bonded to the key body 2, thereby making it possible to firmly mount the black key cover body 11 to the key body 2. Furthermore, the black key cover 4 comprising the black key cover body 11 and the weight 3 received therein is configured such that the black key cover body 11 and the weight 3 can be integrally formed with each other by insert molding, as described hereinafter. This makes it possible to manufacture the black key 1 at lower costs than that of the conventional black key which necessitates the steps of manufacturing the black key cover body 11 and the weight 3 separately from each other, fitting the weight into the black key cover body, and bonding the former to the latter.

Next, a description will be given of a method of manufacturing the black key cover 4. The black key cover 4 is molded by insert molding such that it incorporates the weight 3. It should be noted that in the following, first, a description will be given of a mold for use in insert molding, and then of the step of molding the black key cover 4.

Figure 3:
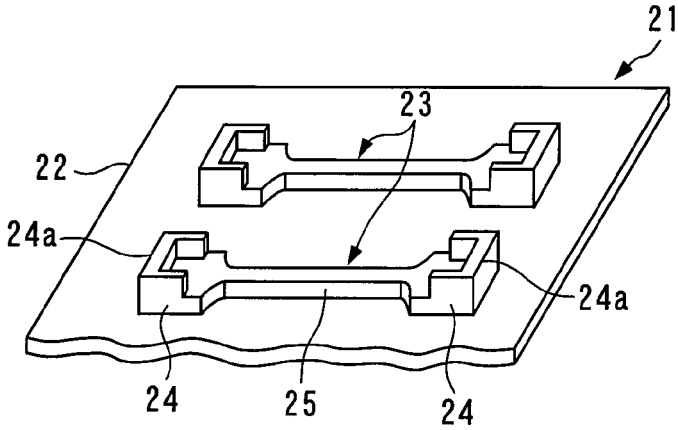
FIG. 3 is a perspective view of part of a lower mold.
Figure 4A:
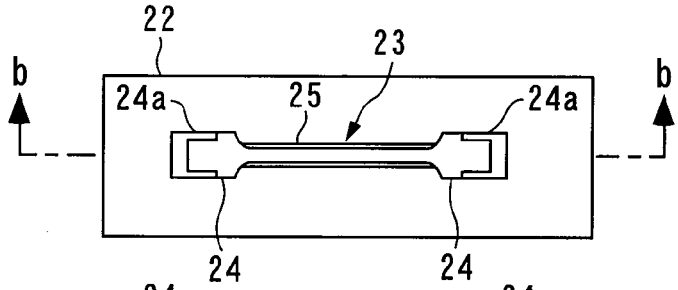
FIG. 4A is a plan view of a pedestal and its vicinity of the lower mold.
Figure 4B:
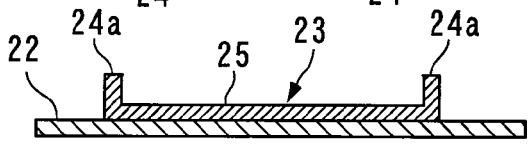
FIG. 4B is a cross-sectional view taken on line b-b of FIG. 4A.

FIG. 3 shows part of a lower mold 21 of a mold for use in insert molding. FIG. 4A shows a pedestal 23 and its vicinity of the lower mold 21 in plan view. As shown in FIGS. 3 and 4A, the lower mold 21 includes a horizontal base 22 and a plurality of the pedestals 23 (e.g. eight, only two of which are shown in FIG. 3) which are arranged on the base 22 in a manner spaced from each other and are integrally formed with the base 22.

Each pedestal 23 is for setting the weight 3 thereon when molding the black key cover 4. The pedestal 23 has a predetermined height and extends on and along the base 22. The pedestal 23 is formed to be longer than the weight 3 and at the same time shorter than the black key cover body 11. Further, opposite ends 24 and 24 of the pedestal 23 each have a width larger than that of an intermediate portion 25 therebetween. The opposite ends 24 and 24 are each formed with an engaging recess 24*a* (positioning portion) which is engaged with the weight 3 set on the pedestal 23, for positioning the weight 3. Walls defining the engaging recess 24*a* protrude upward, and are formed to have a generally U shape opening inward, in plan view. Further, the intermediate portion 25 of the pedestal 23 is formed to have a width smaller than that of the weight 3 and be tapered such that opposite side surfaces thereof become closer to each other as they extend upward. This makes it possible to remove the black key cover 4 easily from the lower mold 21 when the black key cover 4 is molded.

Figure 5A:
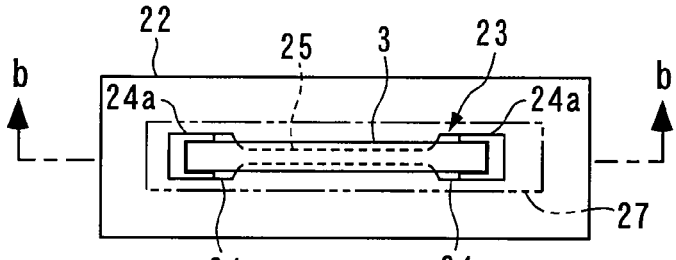
FIG. 5A is a plan view of the pedestal and its vicinity of the lower mold, with the weight set thereon.
Figure 5B:
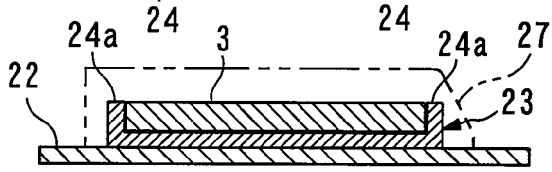
FIG. 5B is a cross-sectional view taken on line b-b of FIG. 5A.
Figure 6A:
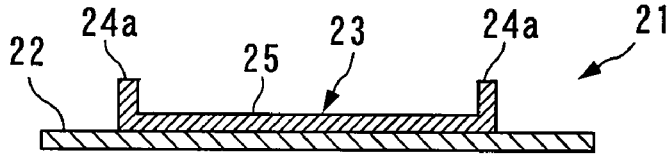
FIGS. 6A to 6E are diagrams which are useful in explaining a sequence of steps for molding the black key cover.
Figure 6B:
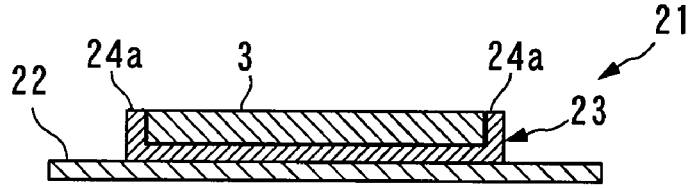
Figure 6C:
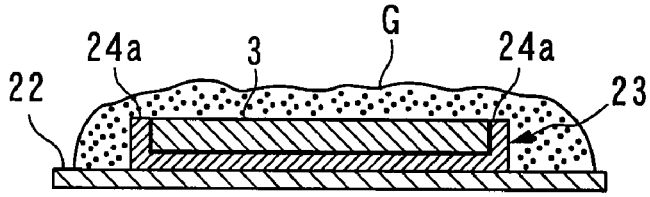
Figure 6D:
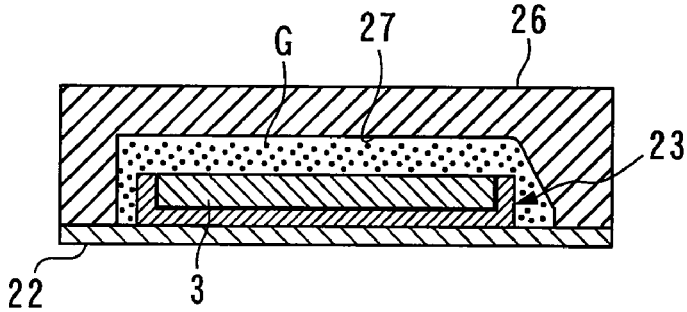

FIGS. 5A and 5B show the weight 3 in a state set on the pedestal 23 when molding the black key cover 4. As shown in these figures, the weight 3 is placed along the pedestal 23 such that the opposite ends thereof are fittedly engaged with the engaging recesses 24*a* and 24*a* of the pedestal 23. This positions the pedestal 23 at a predetermined location within a black key cover 4 to be molded. Further, an upper mold 26 (see FIG. 6D) to be overlaid on the above-described lower mold 21 has a plurality of cavities 27 (only one of which is shown in FIG. 6D) corresponding to the plurality of the pedestals 23 of the lower mold 21. Each cavity 27 has a shape opening downward and complementary to the black key cover 4 to be molded. More specifically, the cavity 27 is formed into a trapezoid in cross section. When the upper mold 26 is overlaid upon the lower mold 21, the pedestal 23 and the weight 3 set thereon are accommodated in the cavity 27, as indicated by two-dot chain lines in FIGS. 5A and 5B.

Next, a sequence of steps for molding the black key cover 4 will be described with reference to FIGS. 6A to 6E. First, weights 3, a lower mold 21, and an upper mold 26 mentioned above are prepared (a weight-preparing step, and a mold-preparing step; only the lower mold 21 is shown in FIG. 6A). Then, a weight 3 is set on each pedestal 23 of the lower mold 21, as shown in FIG. 6B (a weight-setting step). Subsequently, a predetermined powder raw material G is supplied on the base 22 in a manner covering the pedestals 23 and the weights 3, as shown in FIG. 6C (a raw material supply step). The raw material G is a synthetic resin, such as a phenol resin, for constructing the black key cover body 11. When the upper mold 26 is overlaid upon the lower mold 21, the cavity 27 receives therein the pedestals 23, the weights 3, and the raw material G around them, as shown in FIG. 6D. Thereafter, the lower mold 21 and the upper mold 26 are heated at a predetermined temperature (e.g. 150° C.) for a predetermined time period (e.g. three minutes) (a pressurizing and heating step).

From the above, the raw material G in the cavity 27 hermetically sealed by the upper mold 26 and the lower mold 21 is filled around the pedestal 23 and the weight 3 of the lower mold 21 in a molten state under a relatively high pressure. Then, after the raw material G in the cavity 27 is set, the upper mold 26 and the lower mold 21 are separated from each other to remove the molded black key cover 4 from the lower mold 21 (see FIG. 6E).

As described heretofore, according to the method of manufacturing the black key cover 4, since the width of the intermediate portion 25 of the pedestal 23 is smaller than that of the weight 3, the molten raw material G in the cavity 27 flows in under the weight 3, whereby the lower walls 12 and 12 for holding the weight 3 from below are formed. Thus, the same black key cover as the black key cover 4 shown in FIGS. 2A to 2D, i.e. the black key cover 4 in which the black key cover body 11 has the weight 3 received therein and the weight 3 is held by the lower walls 12 and 12 from below is molded. Further, during molding of the black key cover 4, the weight 3 set on the pedestal 23 is positioned by being engaged with the engaging recesses 24*a* and 24*a* of the pedestal 23. This makes it possible to obtain the black key cover 4 that holds the weight 3 in an appropriate position within the same. Furthermore, the above-described insert molding causes the black key cover body 11 to be fused to the weight 3, whereby it is possible to easily manufacture the black key cover 4 in which the black key cover body 11 and the weight 3 are integrally formed with each other and the weight 3 is stably held inside.

Further, the black key cover 4 is molded by overlaying the upper mold 26 upon the lower mold 21 after the raw material G is supplied to the lower mold 21. Therefore, the black key cover 4 can be molded more easily than when it is molded by a method, such as injection molding, in which the upper mold and the lower mold are overlaid upon each other in advance and the raw material is supplied into the cavity hermetically sealed by the upper and lower molds.

Figure 7A:
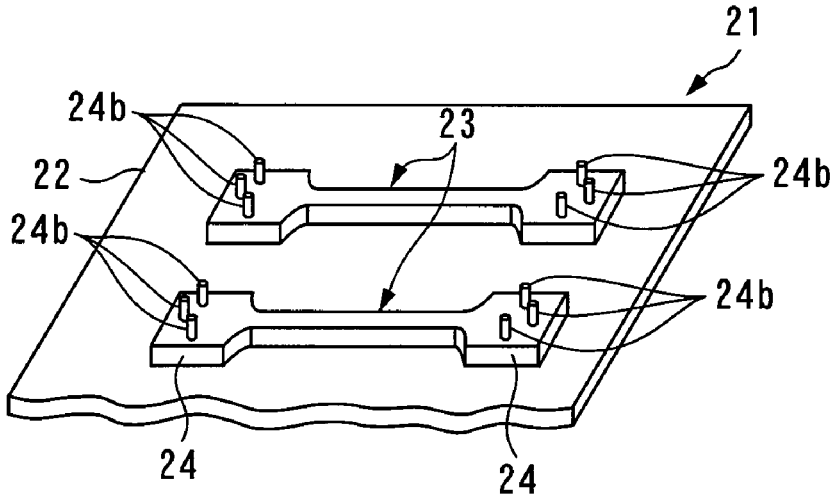
FIGS. 7A and 7B are perspective views of variations of the pedestal of the lower mold.
Figure 7B:
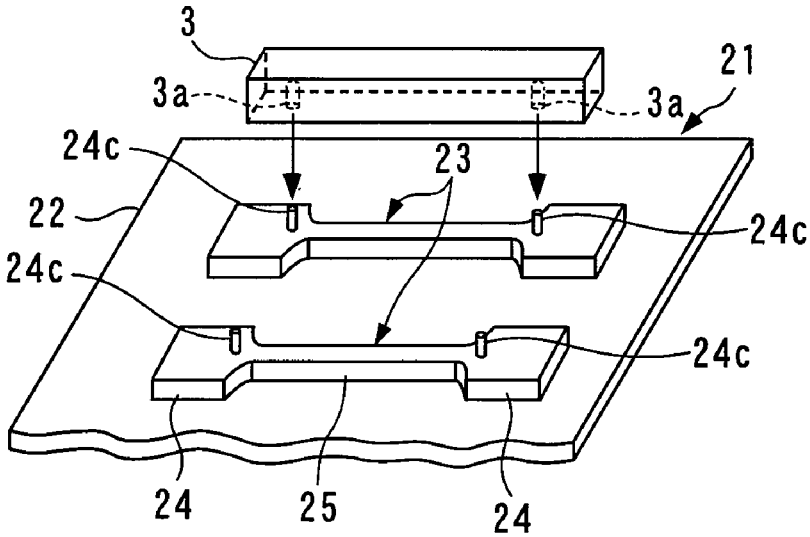

FIGS. 7A and 7B show variations of the pedestal 23 of the lower mold 21. In FIG. 7A, each of ends 24 of the pedestal 23 has three engaging pins 24*b* (positioning portions) erected at predetermined positions thereof in place of the aforementioned engaging recesses 24*a*. In molding the black key cover 4, the weight 3 is set on the pedestal 23 such that it is engaged inside the engaging pins 24*b*. Thus, similarly to the case where the pedestal 23 having the engaging recesses 24*a* is used, it is possible to obtain the black key cover 4 which holds the weight 3 in an appropriate position within the same.

On the other hand, in FIG. 7B, engaging pins 24*c* and 24*c* (positioning portions, protrusions) are erected at respective locations of the opposite ends 24 of the pedestal 23, toward the intermediate portion 25. Further, the weight 3 is formed with two engaging holes 3*a* and 3*a* (engaging portions, recesses) in association with the respective engaging pins 24*c* and 24*c* such that they open in predetermined locations of the lower surface of the weight 3. In molding the black key cover 4, the weight 3 is set on the pedestal 23 such that the engaging pins 24*c* and 24*c* are inserted into the associated engaging holes 3*a* and 3*a* of the weight 3, whereby similarly to the above, it is possible to obtain the black key cover 4 which holds the weight 3 in an appropriate position within the same.

Further, it is preferable that the pedestals 23 are formed by magnets, and the weights 3 are formed of a magnetic material, such as iron, attracted by the pedestals 23. In this case, during molding of the black key cover 4, it is possible to prevent the weight 3 from being lifted by pressure of the raw material G having flowed in under the weight 3. This makes it possible to make smaller the width of the intermediate portion 25 of the pedestal 23, whereby the lower walls 12 and 12 of the black key cover body 11, which are formed by the raw material G having flowed in under the weight 3, are made larger. As a result, the areas of the lower surfaces of the lower walls 12 and 12 become larger, whereby it is possible to increase the bonding area where the black key cover body 11 is bonded to the key body 2. This makes it possible to firmly mount the black key cover 4 on the key body 2.

Figure 8:
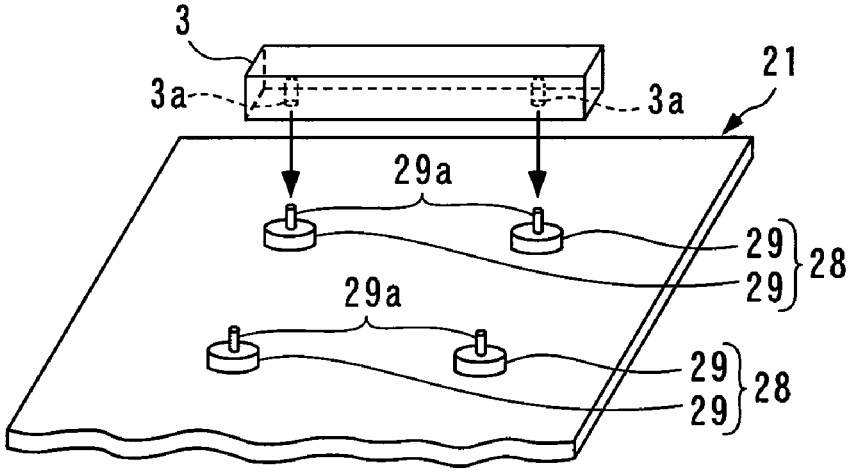
FIG. 8 is a perspective view of another variation of the pedestal of the lower mold.

FIG. 8 shows another variation of the pedestal 23 of the lower mold 21. As shown in FIG. 8, differently from the above-described pedestal 23, this pedestal 28 is formed by two pedestal portions 29 and 29 as a pair, which are arranged at respective locations such that they are spaced from each other by a predetermined distance. Each pedestal portion 29 having the same height as that of the pedestal 23 is formed into a circular shape with a predetermined diameter in plan view, and has an engaging pin 29*a* (positioning portion, projection) erected on the central portion of an upper surface thereof. Further, similarly to the weight 3 shown in FIG. 7B, the weight 3 has a lower surface thereof formed with the two engaging holes 3*a* and 3*a* (engaging portions, recesses) associated with the respective engaging pins 29*a* and 29*a* of the pedestal portions 29 and 29. In molding the black key cover 4, the weight 3 is set on the pedestal 28 such that the engaging pins 29*a* and 29*a* are inserted into the associated engaging holes 3*a* and 3*a*.

Figure 6E:
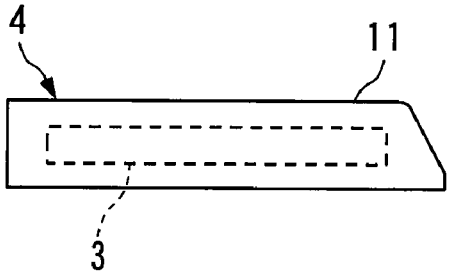
Figure 9A:
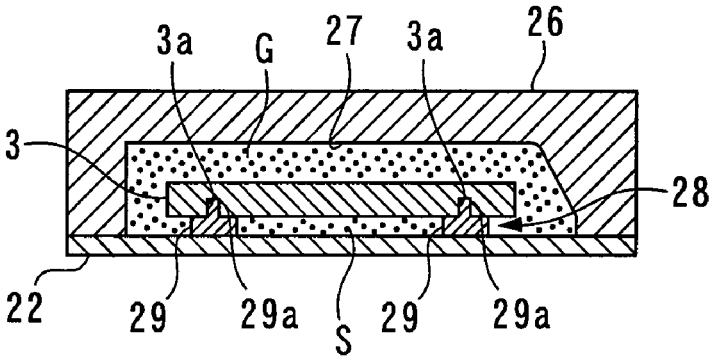
FIGS. 9A and 9B are diagrams which are useful in explaining steps for molding the black key cover by using the FIG. 8 pedestal.
Figure 9B:
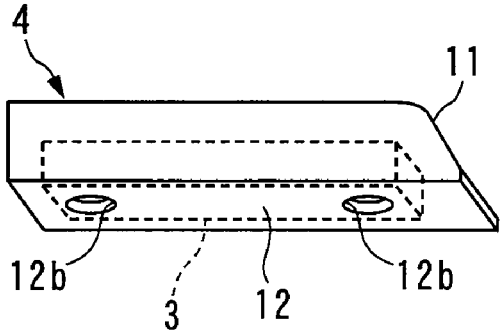

FIGS. 9A and 9B respectively correspond to FIGS. 6D and 6E with reference to which the aforementioned steps for molding the black key cover 4 are described, provided that in FIGS. 9A and 9B, the black key cover 4 is molded with the lower mold 21 having the pedestal 28. As shown in FIG. 9A, when the weight 3 has been set on the pedestal 28, a relatively large space S is defined between the lower surface of the weight 3 and the upper surface of the base 22. The raw material G, which becomes molten within the cavity 27 in the pressurizing and heating step during molding of the black key cover 4, flows in under the weight 3 to fill the space S. Thus, as shown in FIG. 9B, in the molded black key cover 4, a lower wall 12 is formed on a whole lower surface thereof except for portions where the pedestal portions 29 and 29 were arranged.

As described above, if the black key cover 4 is molded with the lower mold 21 having the pedestal 28, it is possible to obtain the black key cover 4 the lower surface of which has an area much larger than that of the lower surface of the black key cover 4 that is molded with the pedestal 23. As a result, the bonding area where the black key cover 4 is bonded to the key body 2 is increased to increase a bonding strength, thereby making it possible to mount the black key cover 4 on the key body 2 more firmly.

It should be noted that the present invention is by no means limited to the embodiment described above, but it can be practiced in various forms. For example, although in the black key cover 4 having the pair of left and right lower walls 12 and 12, the lower walls 12 and 12 are formed such that they protrude inward from the left and right side walls 11*a* and 11*a*, respectively, this is not limitative, but the lower walls 12 and 12 may be formed such that one of them protrudes inward from only one of the left and right side walls 11*a* and 11*a* insofar as the protruding lower wall 12 can hold the weight 3.

Further, although in the aforementioned insert molding for use in molding the black key cover 4, the upper mold 26 is overlaid upon the lower mold 21 after the raw material G is supplied to the lower mold 21, any other suitable molding method may be employed insofar as it makes it possible to obtain the black key cover 4 incorporating the weight 3. For example, it is also possible to mold the black key cover 4 by forming a gate in one of the lower mold 21 and the upper mold 26, for causing the molten raw material G to flow into the cavity 27, thereby performing injection molding or the like. Further, although in FIGS. 7B and 8, the engaging pins 24*c* and 29*a* are provided on the respective pedestals 23 and 28 while the engaging holes 3*a* and 3*a* are provided in the weight 3, it is also possible to invert the concave-convex relationship therebetween. Furthermore, although in FIG. 8, the pedestal 28 formed by the two pedestal portions 29 and 29 is used, the number of the pedestal portions 29 is not limited, but the pedestal may be formed by one or three or more pedestal portions. However, when the pedestal is formed by one pedestal portion 29, to prevent the weight 3 set on the pedestal portion 29 from rotating about the engaging pin 29*a*, it is preferable that the engaging holes 3*a* in the weight 3 and the engaging pins 29*a* on the pedestal portions 29 have shapes other than the shape circular in cross section.

Further, the details of the constructions of the black key 1, the black key cover 4, the black key cover body 11 and the weight 3, and the respective steps of molding the black key cover are described only by way of example, and they can be varied as required so long as the same do not depart from the scope of the invention.

It is further understood by those skilled in the art that the foregoing are preferred embodiments of the invention, and that various changes and modifications may be made without departing from the spirit and scope thereof.

What is claimed is:

1. A black key for a keyboard instrument, comprising:

a key body in an elongate bar shape that extends in a front-rear direction and is swingable, the body lacking the visible, black, playable part of the key that protrudes above the plane of the white keys, when installed;

a black key cover body providing the visible, black, playable part of the key that protrudes above the plane of the white keys, the key cover body formed into a hollow shape opening downward and mounted on a front portion of an upper surface of said key body in a manner covering the front portion; and a weight that is received in said black key cover and adds weight to said key body, wherein said black key cover body as a lower wall protruding inward from a lower edge portion of at least one of the left and right side walls partially covering the said hollow shape, for holding said weight from below, said lower surface having a lower surface bonded to said key body.

2. A black key as claimed in claim 1, wherein said lower wall has left and right wall portions opposed to each other, and wherein surfaces of said left and right wall portions, opposed to each other, are formed to be tapered such that the surfaces become closer to each other as the surfaces extend toward said weight.

3. A method of manufacturing a black key cover for a keyboard instrument, the black key cover being the visible, black, playable part of the black key that protrudes above the plane of the white keys, when installed in a musical keyboard, comprising:

a weight-preparing step of preparing a rod-shaped weight having a predetermined width;

a mold-preparing step of preparing a lower mold that has a base extending horizontal, and a pedestal provided on and along the base and having a width smaller than a width of the weight, said base and said pedestal being integrally formed with each other, and an upper mold that has a cavity opening downward and complementary to a black key cover to be molded; a weight-setting step of setting the weight on and along the pedestal; and a black key cover-molding step of overlaying the upper mold upon the lower mold such that the pedestal and the weight are received within the cavity, and performing insert molding of the black key cover together with the weight, using a synthetic resin supplied to the cavity.

4. A method as claimed in claim 3, wherein said black key cover-molding step comprises:

a raw material supply step of supplying the synthetic resin in a powder form as a raw material of the black key cover body, in a manner covering the pedestal on the base and the weight set on the pedestal; and a pressurizing and heating step of overlaying the upper mold upon the lower mold such that the pedestal and the weight are received within the cavity, and pressurizing and heating the synthetic resin within the cavity, thereby molding the black key cover.

5. A method as claimed in claim 3, wherein the pedestal includes a positioning portion that is engaged with the set weight, and positions the weight at a predetermined location.

6. A method as claimed in claim 5, wherein the weight has a lower surface provided with an engaging portion formed by one of a protrusion and a recess, and wherein the positioning portion is formed by the other of the protrusion and the recess, for engagement with the engaging portion.

7. A method as claimed in claim 3, wherein the pedestal is formed by a magnet, and wherein the weight is made of a magnetic material attracted by the pedestal.

8. A method of manufacturing a black key cover for a keyboard instrument, the black key cover being the visible, black, playable part of the black key that protrudes above the plane of the white keys, when installed in a musical keyboard, comprising:

a weight-preparing step of preparing a rod-shaped weight;

a mold-preparing step of preparing a lower mold that has a base extending horizontal, and a pedestal provided on the base, for defining a space between the weight and the base when the weight is set along the base, said base and said pedestal being integrally formed with each other, and an upper mold that has a cavity opening downward and complementary to a black key cover to be molded;

a weight-setting step of setting the weight on the pedestal such that the weight extends along the base; and a black key cover-molding step of overlaying the upper mold upon the lower mold such that the pedestal and the weight are received within the cavity, and performing insert molding of the black key cover together with the weight, using a synthetic resin supplied to the cavity.

9. A method as claimed in claim 8, wherein said black key cover-molding step comprises:

a raw material supply step of supplying the synthetic resin in a powder form as a raw material of the black key cover body, in a manner covering the pedestal on the base and the weight set on the pedestal; and a pressurizing and heating step of overlaying the upper mold upon the lower mold such that the pedestal and the weight are received within the cavity, and pressurizing and heating the synthetic resin within the cavity, thereby molding the black key cover.

10. A method as claimed in claim 8, wherein the pedestal includes a positioning portion that is engaged with the set weight, and positions the weight at a predetermined location.

11. A method as claimed in claim 10, wherein the weight has a lower surface provided with an engaging portion formed by one of a protrusion and a recess, and wherein the positioning portion is formed by the other of the protrusion and the recess, for engagement with the engaging portion.

12. A method as claimed in claim 8, wherein the pedestal is formed by a magnet, and wherein the weight is made of a magnetic material attracted by the pedestal.

* * * * *